United States Patent [19]

Payne et al.

[11] 4,413,370

[45] Nov. 8, 1983

[54] UNITARY PIG FOR USE IN A PIPELINE

[75] Inventors: Larry D. Payne, Owasso; Hyun J. Cho; Kishor N. Mehta, both of Tulsa, all of Okla.

[73] Assignee: T. D. Williamson, Inc., Tulsa, Okla.

[21] Appl. No.: 293,084

[22] Filed: Aug. 17, 1981

[51] Int. Cl.[3] ..... B08B 9/04

[52] U.S. Cl. ..... 15/104.06 R

[58] Field of Search ..... 15/3.5, 3.51, 104.06 R, 15/104.06 A; 166/153-156, 170

[56] References Cited

U.S. PATENT DOCUMENTS

| | | | |
|---|---|---|---|
| 2,275,190 | 3/1942 | Lowry | 15/104.06 R |
| 2,276,109 | 3/1942 | Smith | 15/104.06 R |
| 3,006,415 | 10/1961 | Burns et al. | 166/156 |
| 3,496,588 | 2/1970 | Vernooy | 15/104.06 R |
| 3,576,043 | 4/1971 | Zongker | 15/104.06 R |
| 3,605,896 | 9/1971 | Perkins | 166/154 X |
| 3,857,132 | 12/1974 | Knapp et al. | 15/104.06 R |
| 4,069,535 | 1/1978 | Cato | 15/104.06 R |
| 4,083,074 | 4/1978 | Curtis | 166/153 X |
| 4,275,475 | 6/1981 | Schwartz et al. | 15/104.06 R |

FOREIGN PATENT DOCUMENTS

| | | | |
|---|---|---|---|
| 2038987 | 7/1980 | United Kingdom | 15/104.06 R |
| 422,479 | 9/1974 | U.S.S.R. | 15/104.06 R |

*Primary Examiner*—Edward L. Roberts

*Attorney, Agent, or Firm*—Head, Johnson & Stevenson

[57] ABSTRACT

An improved pig for use in a pipeline is provided in which the basic structure including a body and the cup portions integrally formed of a unitary design, the body being of an elongated cylindrical configuration, including at least a forward and rearward cup extending from the body, the diameter of the cups being at least two and not more than five times the diameter of the body, the normal diameter of the cups in non-used condition being slightly greater than the internal diameter of the pipeline for which the pig is dimensioned and the length of the body being at least 1½times the normal diameter of the cups. In a preferred arrangement the body is hollow or tubular for a substantial portion of its length and has an insert of a tubular rigid material; the thickness of the cups is less adjacent the body and the increases in thickness towards the peripheral surface; and the rearward cup has pressure equalizing openings.

26 Claims, 11 Drawing Figures

UNITARY PIG FOR USE IN A PIPELINE

BACKGROUND OF THE INVENTION

1. Field of the Invention

This invention relates to pipeline pigs for use in filling or emptying pipelines, for efficient cleaning of the interior of pipelines, for internal corrosion control and for fluid separation and gathering.

2. Description of the Prior Art

The use of apparatus for moving by fluid flow in the interior of a pipeline, the apparatus being generally known as a pipeline "pig", is commonly employed in industry. Pipeline pigs perform a wide range of useful functions. They are employed during the construction of pipelines as well as during the operational life of pipelines. Pipeline pigs may be run on a one-time or special purpose basis or on a periodic schedule. Pigs are essential for effectively filling or emptying of pipelines, for efficient cleaning, for internal corrosion control, and for fluid separation and gathering.

For general information as to the application and use of pipeline pigs, reference may be had to an article entitled: "Fundamentals of Pipeline Pigging", authored by Burt VerNooy, appearing in *Pipeline Industry,* September/October 1980, published by the Gulf Publishing Company, Houston, Tex.

For additional background relating to pipeline pigs of the type to which the present invention pertains, reference may be had to the following prior issued U.S. patents:

Novotny—U.S. Pat. No. 646,545
Bergesen, Jr.—U.S. Pat. No. 1,392,105
Ford—U.S. Pat. No. 1,713,895
Smith—U.S. Pat. No. 2,276,109
VerNooy—U.S. Pat. No. 2,909,796
Muirhead—U.S. Pat. No. 3,939,519
Curtis—U.S. Pat. No. 4,083,074
Krouse et al.—U.S. Pat. No. 4,178,649

The present invention is intended to accomplish the same purpose as pipeline pigs in current use in the pipeline industry, but is distinguished over the prior art in the provision of an improved unitary construction wherein the body and cup portions are integrally formed of a non-metallic material such as natural or synthetic rubber or plastic. The pipeline pig of this invention is particularly adaptable for construction of urethane.

The invention provides a highly effective and yet simple and inexpensive pig for use in pipelines having improved means of effectively sealing the interior of the pipeline by the outwardly extending cups but in an arrangement wherein the pig is flexible and is capable of negotiating relatively sharp turns while at the same time providing a pig of inherent strength and effectiveness.

SUMMARY OF THE INVENTION

An improved pig for use in a pipeline is provided and is characterized by an elongated cylindrical body having a forward and rearward end. The cylindrical body preferably has an axial recess therein in the major rearward portion so that the body rearward portion is tubular. Received within the tubular portion is a sleeve or reinforcing member which is of stiff material such as metal or hard plastic. The sleeve adds strength and rigidity to the body. Integrally extending outwardly and rearwardly from the body are cups, there being at least a forward cup at the forward end of the body and a rearward cup at the rearward end of the body. Some embodiments of the invention include the use of at least one intermediate cup. When an intermediate cup is employed it is spaced rearwardly of the forward cup with the spacing between the intermediate cup and the rearward cup being at least twice the spacing between the intermediate cup and the forward cup.

The pipeline pig is integrally formed with the body and cups being molded of a resilient, non-metallic material such as natural or synthetic rubber or plastic with urethane being an example of an ideal material. The cups are therefore flexible and resilient and are deformable by pressure to be received within the interior of a pipeline and moved along by fluid flow within the pipeline with the external peripheral surface of the cup engaging the pipeline wall. In order to provide the required resiliency and to ensure the stability of the pig, the cup should have a diameter of at least two and not more than five times the diameter of the body portion, and the length of the body should be at least 1½ times the diameter of the cups.

The rearward cup is provided with openings to equalize fluid pressure on either side of it so that the fluid pressure providing motivative force to move the pipeline pig is applied against the forward cup or forward cups when more than one is employed, with the rearward cup being free of pressure differential and functioning to stabilize the pig as it moves through the pipeline. Other innovative features include a recess in the forward end of the pig to provide a more resilient forward end to function as a bumper surface to reduce damage to the pig and to portions of the pipeline if the pig encounters an object as it flows through a pipeline. Other features include the provision of a band affixed to the exterior of the body rearwardly of the forward cup with a plurality of leaf springs extending from the band and with a cleaning means on the outer leg of each spring positioned to engage the interior of the pipeline. The cleaning means may be a brush or scraper. With the provision of springs and cleaning means, the pig functions to remove rust and encrustation to thereby keep the interior of pipelines clean.

DETAILED DESCRIPTION

Figure 1:
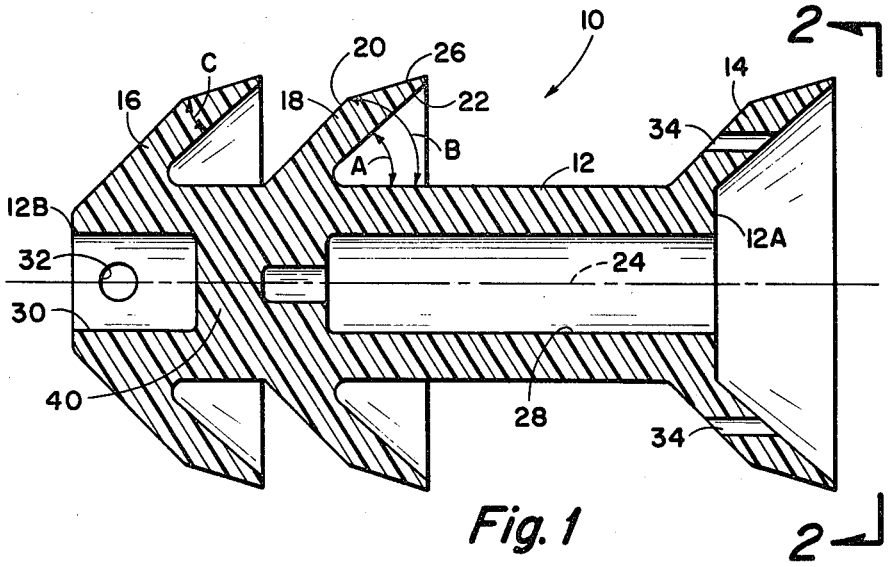
FIG. 1 is a cross-sectional view of one embodiment of the invention wherein all portions of the pipeline pig integrally formed of a non-metallic material and wherein a forward, a rearward and an intermediate cup is employed.
Figure 2:
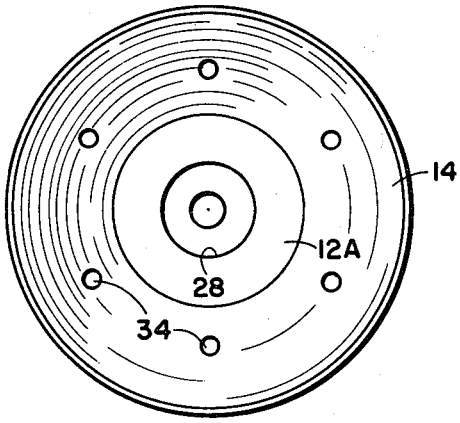
FIG. 2 is an end view of the rearward end of the pipeline pig of FIG. 1 as taken along the line 2—2 of FIG. 1

Referring to the drawings and first to FIGS. 1 and 2, an embodiment of the invention is illustrated. The pipeline pig is generally indicated by the numeral 10 and is formed of a body 12 which is elongated and preferably cylindrical. Integrally extending from the rearward end 12A of the body is a rearward cup 14. Integrally extending from the body forward end 12B is a forward cup 16. In its simplest embodiment, the pig employs only rearward and forward cups 14 and 16; however, in the illustrated embodiment and the arrangement preferred on pigs for heavier duty application, an intermediate cup 18 is employed. The intermediate cup 18 is spaced rearwardly of and adjacent the forward cup 16. The spacing between intermediate cup 18 and rearward cup 14 is at least twice the spacing between the intermediate cup 18 and the forward cup 16.

Each of the cups 14, 16, and 18 is of a conical configuration, that is, has a frusto-conical forward surface 20 and also a frusto-conical rearward surface 22. The rearward surface 22 of each of the cups extends outwardly and rearwardly from the body 12 at an angle A, which angle may vary between 30° and 75°. It can be seen that the angle A is the same as the angle of intersection of the plane of the cup inner surface 22 in cross-section if projected to meet the longitudinal axis of the body indicated by dashed line 24. The plane of the forward surface 20 in cross-section, has an angle B relative to the body 12, which is equal to the angle relative to the axis 24. Angle B is the same as or preferably somewhat greater than the angle A. When the angle B is greater than angle A, being the preferred arrangement, the thickness of the cups increases in the direction away from the body 12 until the start of the sealing surface 26. The angle C of the sealing surface 26 relative to the inner surface 22 is between 10° an 30° with 20° to 25° being preferred.

The provision wherein the thickness of the cups increases with increased diameter has several advantages which would not be initially apparent. First, by having the portions adjacent the body 12 of a thinner cross-sectional arrangement, the cups have more flexibility so as to deform more readily to conform to the interior of pipe. While pipelines are normally round, accidents during construction and after pipelines are installed frequently cause pipelines to get out-of-round and become oval, dented, bent or buckled. Thus cups which are more readily deformable as a pig passes through a pipeline provide superior service to less deformable cups. At the same time, since the cups are thicker at the outer portions adjacent the sealing surface 26, more support is given to the reduced thickness sealing surfaces to hold the sealing surfaces for proper engagement with the interior wall of the pipe as the pig passes through a pipeline. Having the cups thinner in the areas wherein they integrally join with base 12 reduces the material required to construct the pig and reduces the weight of the pig.

The ratio of the diameter of the cups 14, 16, and 18 relative to the diameter of body 12 is important. The diameter of the cups should be at least two and not more than five times the diameter of the body portion 12. It has been learned that this arrangement provides a pig configuration wherein the integral cups are securely supported to the body but wherein maximum flexibility of the cups is provided for conforming to irregularities in the cross-sectional shape of pipe through which the pig is required to pass.

The body 12 has a rearward recess 28 which is co-axial with the longitudinal axis 24 so that the body rearward portion is tubular. The provision of the recess 28 serves to substantially reduce the quantity of material required for the construction of the pig and therefore reduces the weight of the pig.

In the preferred arrangement as illustrated in FIG. 1, a forward recess 30 is also provided which is co-axial with the longitudinal axis 24 and communicates with the pig forward end 12B. The recess 30 serves also to reduce the weight and the quantity of material required to manufacture the pig but, in addition, achieves another important advantage. As pigs move through a pipeline, they frequently encounter objects such as a closed valve, the end of a pig catcher, or so forth. Since pigs can become relatively heavy when of large sizes, damages to the pig and to the pipeline equipment which is encountered by the pig can result. By the provision of opening 30, the forward end 12B achieves an effective bumper configuration so that shock is absorbed when the pig engages a physical object to thereby diminish the chance of the pig itself being damaged or the pipeline or equipment associated with the pipeline being damaged.

An opening 32 is formed in the body adjacent the forward end 12B, the opening 32 intersecting the recess 30. The axis of the opening 32 is diametrical to and intersects the longitudinal axis 24. The opening 32 provides means of hooking onto a pig to assist in the removal of the pig from the interior of a pipeline.

An additional improvement revealed in FIGS. 1 and 2 is the provision in the rearward cup 14 of a plurality of pressure equalizing openings 34, six being shown in FIG. 2. The openings 34 provide means for the flow of fluid past cup 14 so that pressure is equalized to either side of the cup. In this manner, as the pig passes through a pipeline there is no significant pressure differential across the rearward cup 14. This means that the force to move the pig through the pipeline is applied to the forward cup 16 or, when an intermediate cup 18 is employed as illustrated in FIG. 1, the motivative force of the fluid flow is applied to the forward and intermediate cups 16 and 18. In this manner, the force moving the pig through a pipeline tends to pull rather than push the pig. It can be seen that if force is applied to the rearward cup 14 there would be a tendency for the body 12 to buckle or for the forward cups to be urged to one side or another against the walls of the pipeline. This would increase the possibility of the pig malfunctioning or becoming trapped within a pipeline.

Figure 3:
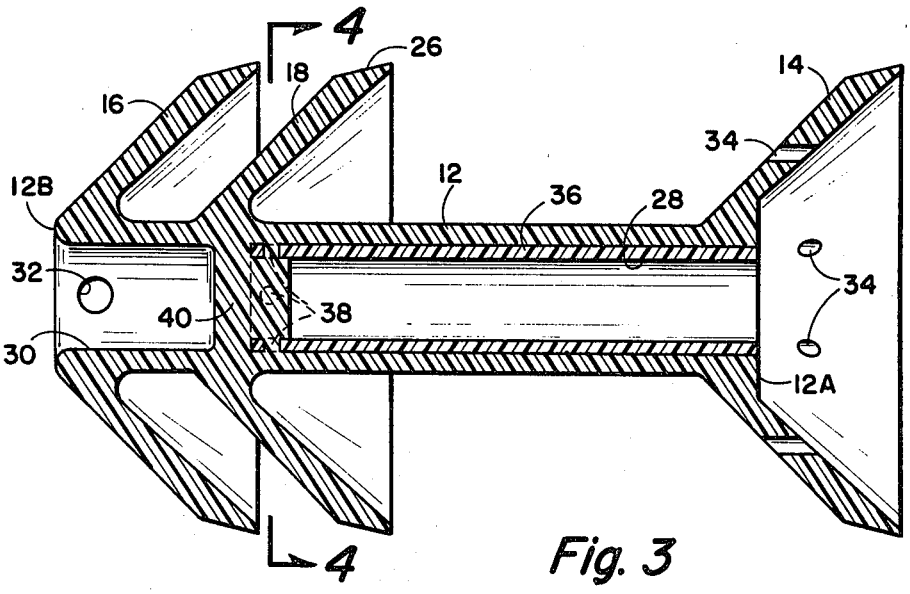
FIG. 3 is a cross-sectional view of an alternate embodiment of the invention wherein a reinforcing sleeve is employed.
Figure 4:
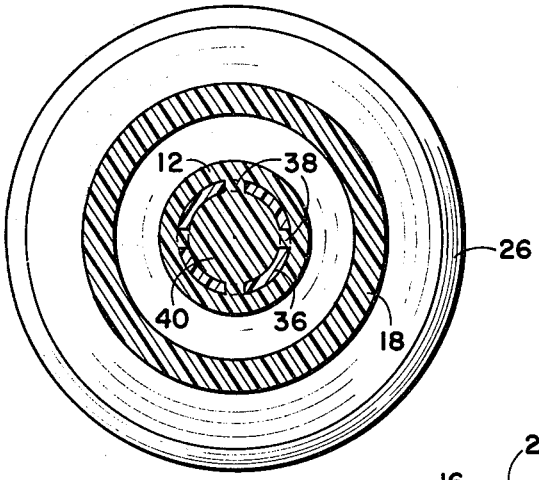
FIG. 4 is a cross-sectional view taken along the line 4—4 of FIG. 3.
Figure 5:
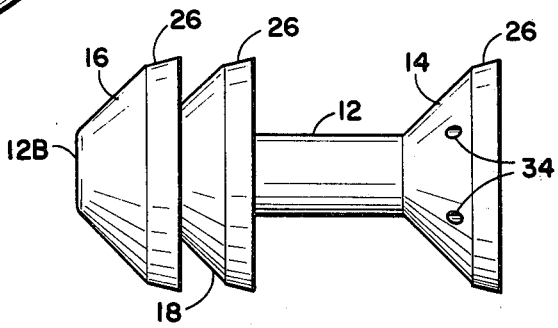
FIG. 5 is an external view of the embodiment of FIG. 3 shown in reduced size.

FIGS. 3 and 4 show an alternate embodiment of the invention in which an insert 36 is positioned in recess 28. The insert 36 may be solid but preferably is, as illustrated, hollow or tubular and is of stiff plastic or metal. The insert 36 may be inserted into the recess 28 after the body and the integral cups are formed but must in some way be retained in the recess. This could be accomplished by the use of adhesive or bonding material, by the use of bolts in a manner which will be hereinafter described, or, as illustrated in FIGS. 3 and 4, a means is provided for retaining the insert 36 in the recess in an integral manner. In this method radial holes 38 are drilled in the insert 36 adjacent the forward end thereof. The holes 38 intersect the longitudinal axis of the insert. At the time the body and integral cups are molded they can be formed about the insert 36. In this way, material penetrates through the openings 38 so that the insert is integrally locked within the body. While this invention is not directed towards a method of manufacturing the pig, it can be seen that in molding the pig of FIG. 3, a removable plug can be inserted in the insert 36 to form the boundary of the body material to ensure that the body material encompasses the portion having the holes 38 therein.

The function of the insert 36 is to add strength and rigidity to the body. By using a stiff tubular member such strength and rigidity can be achieved without substantially increasing the weight of the pig.

The arrangement of FIGS. 1 and 3 wherein rearward recesses 28 and forward recesses 30 are employed provides a space between such recesses including a solid body portion 40. This solid body portion is desirable for two reasons. First, it blocks fluid flow which would otherwise occur if recesses 28 and 30 were joined, that is, if the recess extended entirely through the body. Since the pig is propelled through a pipeline by the force of fluid flow, it would be necessary to close this passageway in some manner and the provision of the solid body portion 40 is a good way of effecting such closure. A second advantage of the solid body portion 40 in its position toward the forward end of the pig is that it adds strength to the areas which support the forward cup 16 and intermediate cup 18. It is this area where maximum stress is applied to the body since the force of fluid flow against the cup is transmitted to the body as the pig is moved through a pipeline.

Figure 6:
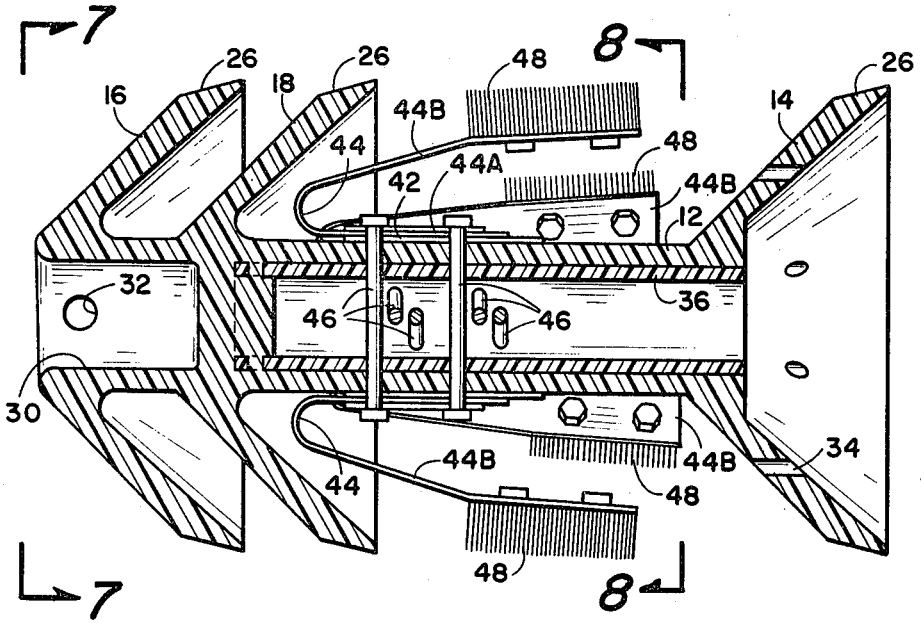
FIG. 6 is a cross-sectional view of an additional alternate embodiment, the body of the pipeline pig being the same as that shown in FIG. 3 but disclosing the method wherein the pig may employ internal pipeline scraping or cleaning devices.
Figure 8:
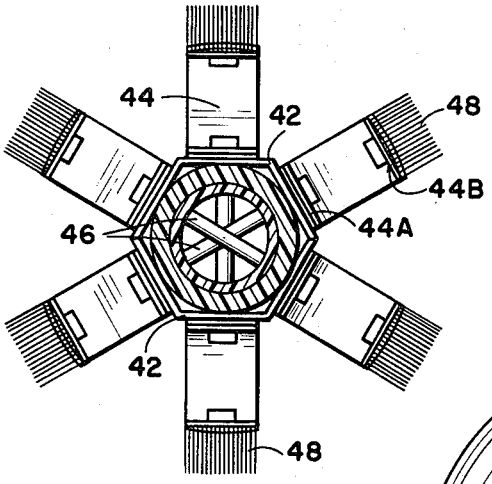
FIG. 8 is a cross-sectional view taken along the line 8—8 of FIG. 6 and showing more details of the arrangement of means for mounting pipe cleaning apparatus to the pig.
Figure 7:
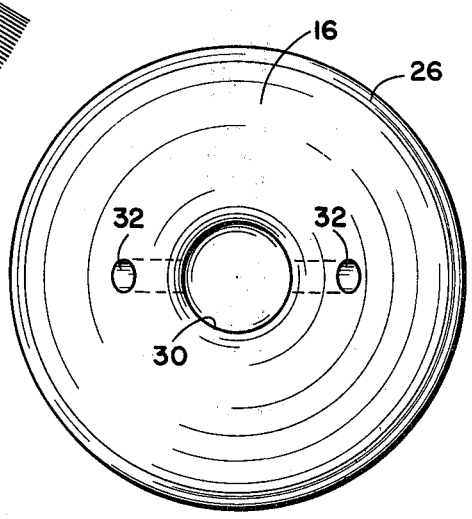
FIG. 7 is an end view taken along the line 7—7 of FIG. 6.

FIGS. 6, 7, and 8 show an alternate arrangement of the invention. A band of stiff material, such as metal, is positioned about the body 12 rearwardly of the intermediate cup 18. In the arrangement illustrated the band 42 is hexagonal although it may be of any equilateral polygon from 3 on up; but for most applications, the use of a hexagonal, octagonal, or greater sided polygonal band 42 is preferred. A U-shaped spring 44 is affixed to each flat exterior side of the band 42. Each of the springs 44 has an inner leg 44A and an outer leg 44B. The outer leg extends rearwardly and outwardly from the body 12. Springs 44 and band 42 are secured to the body 12 by use of bolts 46.

Affixed to the spring outer leg 44B is a pipe engaging means, such as a brush 48. Thus in the arrangement wherein the band 42 is hexagonal, there will be six springs 44 and six brushes 48. These brushes can be configured to engage substantially all of the internal circumferential surfaces of the pipe through which the pig is moved, or the brushes may be narrower permitting gaps between the brushes in the manner illustrated. Where pigs are passed frequently through pipelines for cleaning purposes, the occurrence of gaps between the brushes is satisfactory since as a consequence of many passages of pigs and their indifferent circumferential orientation as they pass through a pipeline, all portions of the pipeline are ultimately contacted and cleaned.

Instead of brushes 48, scrapers or other pipe cleaning devices for engaging the interior of a pipeline to clean it and remove rust, encrustation, or other material may be employed.

The use of brushes, scrapers or the like is well known, and the use of flat or leaf springs for holding brushes or scrapers outwardly and to contact the interior of a pipe is also a known technique. However, this invention provides means which employs the use of polygonal brackets whereby brushes, scrapers or the like may be adapted to a pig formed all of an integrally cast resilient material. The other known pipeline pigs which include scrapers have been typically formed of metal or at least have metal bodies or rigid portions which serve to support the spring held scrapers or brushes. The provision wherein such devices are useful with the pipeline pig of otherwise non-metallic configuration has advantages over the prior art in providing improved economy in the construction of a pipeline cleaning pig as well as the other advantages of integral body and cup arrangements which have been previously mentioned.

Figure 10:
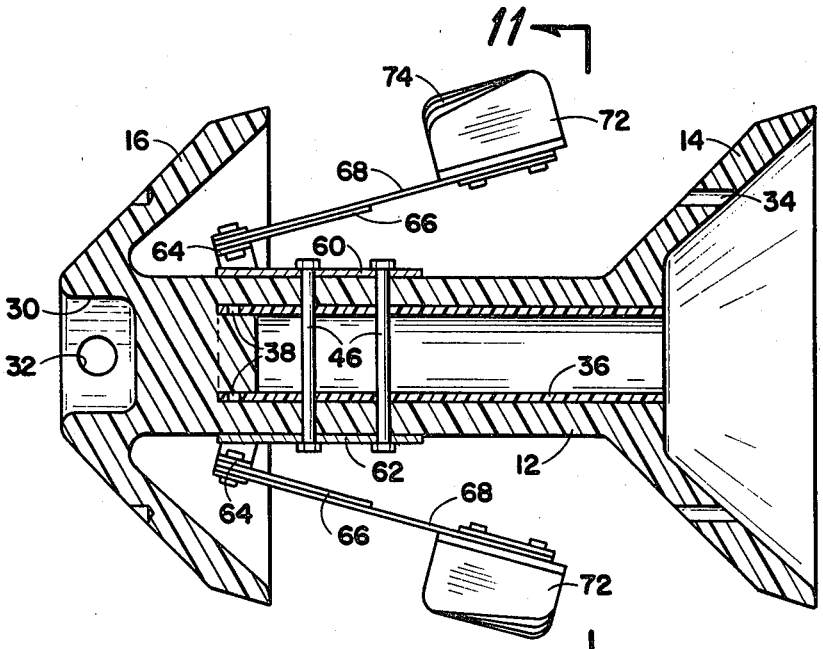
FIG. 10 is a cross-sectional view of an embodiment of the pig having a single forward and rearward integral cup and employing a straight spring for resiliently supporting scrapers.

FIG. 10 is a cross-sectional view of an embodiment of the pig of this invention having a single forward and rearward integral cup and employing a straight spring for resiliently supporting scrapers affixed to the pig body.

Figure 11:
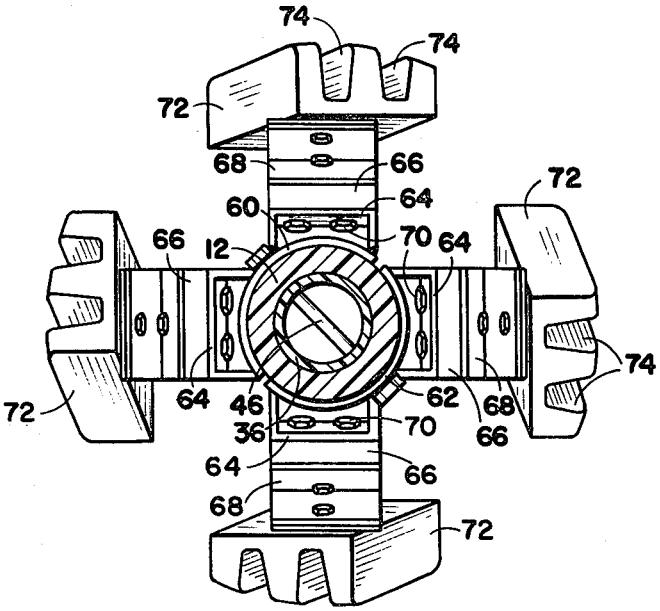
FIG. 11 is a cross-sectional view taken along the line 11—11 of FIG. 10.

FIG. 11 is a cross-sectional view taken along the line 11—11 of FIG. 10 showing the body of the pig in cross-section and showing the configuration of straight springs and scapers as employed in connection with the unitary pig for scraping the interior of a pipeline.

FIGS. 10 and 11 show alternate arrangements of the invention used for supporting brushes or scrapers. In this arrangement, metal bands 60 and 62 are positioned on the exterior of the pig body 12. The bands 60 and 62 are semi-cylindrical so that their interior cylindrical surfaces engage the exterior surface of body 12. The bands when positioned on the body substantially encompass the body and are held in position by bolts 46 which extend completely through the bands, the body 12, and the rigid inserts 36 although use of such insert is not mandatory in practicing the embodiment of the invention illustrated in FIGS. 10 and 11. Secured to the outer surfaces of the bands 60 and 62 are brackets 64, four being shown. Each of the brackets 64 has a relatively straight portion with perpendicularly extending legs at each end. The ends of the leg portions are secured to the bands 60 and 62, such as by welding. Supported to the outer surfaces of each bracket flat portion is a short leaf spring 66; and parallel to it, and contiguous with it, is a long leaf spring 68. The short and long leaf springs 66 and 68 are secured to each of the brackets 64 by means of bolts 70.

At the outer end of long springs 68 is a scraper blade 72. The shape of the scraper blade 72 may vary considerably. In the illustrated arrangement the blades are of the type which may be metal or hard plastic material and are relatively wide providing grooves 74 which are inclined in planes which are askew to the longitudinal axis of the pig body 12. When the pig is inserted into the pipeline, the springs 66 and 68 are deflected to urge the scraper blades 72 into contact with the interior of the pipeline, so that as the pig moves through the line, rust and other encrustations are dislodged.

Thus the embodiments of FIGS. 10 and 11 illustrates an alternate means of affixing physical apparatus to the body 12 of a unitary pipeline pig formed of non-metallic material in which the body and cup are integrally formed.

Figure 9:
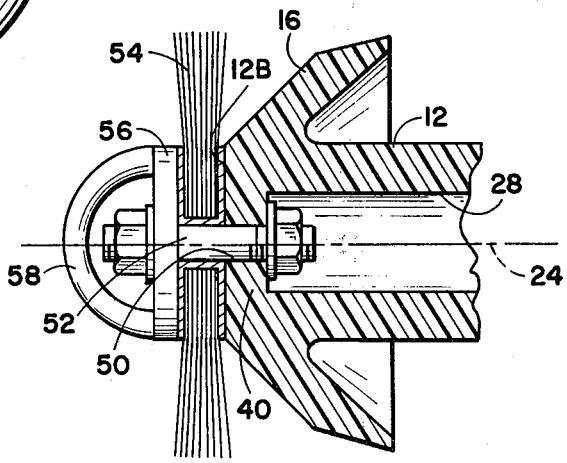
FIG. 9 is a cross-sectional view of the forward end portion of an alternate embodiment of the invention wherein only a single forward cup is employed and wherein a radially extending circular brush is attached to the forward end of the pipeline pig for engaging the interior walls of the pipeline in which the pig is passed.

An additional means of mounting a pipe cleaning attachment to the unitary pipeline pig described herein is illustrated in FIG. 9. In this arrangement there is no forward recess and the rearward recess 28 extends to very near the pig forward end 12B. Thus the body solid portion 40 is immediately adjacent the forward end 12B. An opening 50 is provided in the solid body portion 40 which is co-axial with the body longitudinal axis 24. A bolt 52 is positioned in opening 50 and retains a circular radially extending brush 54. The diameter of the brush is such as to provide a circumferential surface to engage the interior of the pipe through which the pig is to be used. As a means of retaining the brush 24 in position, a metallic noise plug 56 is employed which has a base portion serving in the nature of a washer and with an integral semi-circular ring portion 58 provides means whereby the pig may be easily removed from within the interior of a pipeline. The use of circular radially extending brushes 54 and the type of nose portion 56 is a known technique; however, the prior art has not taught the adaptation of such brushing arrangement in conjunction with an all-plastic integral pig.

The invention as described fulfills all of the purposes and objectives initially set forth. While the pig as illustrated herein for purposes of demonstrating embodiments in which the invention may be employed, may, on initial appearance, seem to encompass general design formats previously known for pipeline pigs, nevertheless, the design as illustrated and designed incorporates features and advantages which are unique and which are not obvious to those skilled in the art of the manufacture of pipeline pigs. The invention provides a simple, yet highly effective and efficient pipeline pig which can be economically manufactured with a minimum of material but at the same time is extremely dependable and of long useful life.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. An improved pig for use in a pipeline comprising:

an elongated cylindrical body of moldable semirigid material having a forward end and a rearward end;

a plurality of cups integrally extending from said body, each cup extending rearwardly and outwardly to a peripheral pipe engaging surface, at least a major portion of said body having an axial opening therein;

an elongated insert of stiff material received in said axial opening serving to increase the rigidity of said body, said elongated insert having at least one recess in the exterior surface whereby said body and integral cups are cast in place about said insert, material forming said body and cups entering said recess to lock said insert to said body.

2. An improved pipeline pig according to claim 1 wherein each said cup has a forward exterior and a rearward interior conical configuration, and wherein the thickness of the cups as measured perpendicular the interior surface is greater in the outer portions than adjacent the body, and wherein the outer peripheral surface of each cup is tapered to a relatively thin circumferential pipe engaging surface.

3. An improved pipeline pig according to claim 1 wherein each of said cups has an interior and an exterior conical configuration and wherein the angle of the forward exterior conical surface relative to the body longitudinal axis is greater than the angle of the rearward internal conical surface relative to the body longitudinal axis.

4. An improved pipeline pig according to claim 1 wherein said rearward cup has at least one opening therethrough providing a fluid passageway whereby pressure across the rearward cup is equalized.

5. An improved pipeline pig according to claim 1 including an intermediate cup extending from said body rearwardly of and spaced from said forward cup, the intermediate cup extending rearwardly and outwardly to peripheral pipe engaging surface of a diameter the same as said forward and rearward cups, the spacing between the intermediate cup and said rearward cup being at least twice the spacing between the intermediate cup and said forward cup.

6. An improved pipeline pig according to claim 1 wherein the rearward portion of said body has an axial recess therein and wherein the forward portion of said body also has an axial recess therein, the recesses being separated by a solid body portion, the forward recess being of short axial length compared to the rearward recess and wherein the forward end of said body has an opening therethrough perpendicular the body longitudinal axes and intersecting said forward recess, the opening providing means for engaging the pipeline pig to facilitate its removal from a pipeline.

7. An improved pipeline pig according to claim 1 including a band of stiff material positioned around said body rearwardly of said forward cup;

a plurality of leaf springs affixed to said band, each spring having the first end affixed to said band, the second end extending rearwardly and outwardly and spaced from said body; and pipe cleaning means affixed to the second end of each spring whereby said cleaning means is biased outwardly into engagement with the walls of a pipeline in which the pig is positioned.

8. An improved pipeline pig according to claim 7 in which each said leaf spring first end, said band, said pig body and said insert have aligned openings therethrough perpendicular the body longitudinal axis, and including bolts extending through said aligned opening to secure said springs and said band to said body.

9. An improved pipeline pig according to claim 1 including a circular brush affixed to said body forward end, the axis of the brush being coincident with said body longitudinal axis, the brush extending radially from said body longitudinal axis, the circumferential surface engaging the interior wall of a pipeline for which the pig is dimensioned.

10. An improved pig according to claim 1 wherein said insert is in the form of a tube of stiff material.

11. An improved pig for use in a pipe line comprising:

an elongated cylindrical body having a forward end portion and a rearward end portion, at least a major portion of the body having an axial opening therein;

at least one forward cup extending from said body forward end portion, the cup extending rearwardly and outwardly to a peripheral pipe engaging surface;

at least one rearward cup extending from said body rearward end portion, the cup extending rearwardly and outwardly to a peripheral pipe engaging surface, the body and said cups being integrally formed of non-metallic material, and wherein said rearward cup has an opening therethrough providing a fluid passageway whereby pressure across said rearward cup is equalized, and an insert of stiff material received in said axial opening serving to increase the rigidity of said body.

12. An improved pig according to claim 11 wherein said insert is in the form of a tube of stiff material.

13. An improved pig according to claim 11 wherein said insert has at least one opening therethrough, the axis of which intersects the insert longitudinal axis, whereby said body and integral cups is cast in place about said insert, material forming said body and cups entering said opening to lock said insert to said body.

14. An improved pipeline pig according to claim 11 wherein each said cup has a forward exterior and a rearward interior conical configuration, and wherein the thickness of the cups as measured perpendicular the interior surface is greater in the outer portions than adjacent the body, and wherein the outer peripheral surface of each cup is tapered to a relatively thin circumferential pipe engaging surface.

15. An improved pipeline pig according to claim 11 wherein each of said cups has an interior and an exterior conical configuration and wherein the angle of the forward exterior conical surface relative to the body longitudinal axis is greater than the angle of the rearward internal conical surface relative to the body longitudinal axis.

16. An improved pipeline pig according to claim 11 wherein said at least one forward cup includes a first and a rearwardly spaced second cup and wherein said at least one rearward cup is a single cup, the spacing between the second cup and said rearward cup being at least twice the spacing between the first and second cups.

17. An improved pipeline pig according to claim 11 wherein the rearward portion of said body has an axial recess therein and wherein the forward portion of said body also has an axial recess therein, the recesses being separated by a solid body portion, the forward recess being of short axial length compared to the rearward recess and wherein the forward end of said body has an opening therethrough perpendicular the body longitudinal axes and intersecting said forward recess, the opening providing means for engaging the pipeline pig to facilitate its removal from a pipeline.

18. An improved pig for use in a pipeline comprising:

an elongated cylindrical body of semi-rigid moldable plastic material having a forward end portion and a rearward end portion;

at least one integral molded forward cup extending from said body forward portion;

at least one integral molded rearward cup extending from said body rearward end, each cup extending rearwardly and outwardly to a peripheral pipe engaging surface;

a band of stiff material positioned around said body rearwardly of said forward cup;

a plurality of leaf springs affixed to said band, each spring having the first end affixed to said band, the second end extending rearwardly and outwardly and spaced from said body; and pipe cleaning means affixed to the second end of each spring whereby said cleaning means is biased outwardly into engagement with the walls of a pipeline in which the pig is positioned.

19. An improved pipeline pig according to claim 18 in which each said leaf spring first end, said band, said pig body and said insert have aligned openings therethrough perpendicular the body longitudinal axis, and including bolts extending through said aligned opening to secure said springs and said band to said body.

20. An improved pig according to claim 18 wherein at least a major portion of said body has an axial opening therein and including:

an insert of stiff material received in said axial opening serving to increase the rigidity of said body.

21. An improved pig according to claim 20 wherein said insert is in the form of a tube of stiff material.

22. An improved pig according to claim 20 wherein said insert has at least one opening therethrough, the axis of which intersects the insert longitudinal axis, whereby said body and integral cups are cast in place about said insert, material forming said body and cups entering said opening to lock said insert to said body.

23. An improved pipeline pig according to clam 18 wherein each said cup has a forward exterior and a rearward interior conical configuration, and wherein the thickness of the cups as measured perpendicular the interior surface is greater in the outer portions than adjacent the body, and wherein the outer peripheral surface of each cup is tapered to a relatively thin circumferential pipe engaging surface.

24. An improved pipeline pig according to claim 18 wherein each of said cups has an interior and an exterior conical configuration and wherein the angle of the forward exterior conical surface relative to the body longitudinal axis is greater than the angle of the rearward internal conical surface relative to the body longitudinal axis.

25. An improved pipeline pig according to claim 18 wherein said rearward cups each have at least one opening therethrough providing a fluid passageway whereby pressure across the rearward cups is equalized.

26. An improved pipeline pig according to claim 18 including a circular brush affixed to said body forward end, the axis of the brush being coincident with said body longitudinal axis, the brush extending radially from said body longitudinal axis, the circumferential surface engaging the interior wall of a pipeline for which the pig is dimensioned.

* * * * *